US011350684B2

(12) United States Patent
Beck et al.

(10) Patent No.: US 11,350,684 B2
(45) Date of Patent: Jun. 7, 2022

(54) VENTILATION ELEMENT

(71) Applicant: adidas AG, Herzogenaurach (DE)

(72) Inventors: Louis Samuel Beck, Herzogenaurach (DE); Stefan Schenk, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 149 days.

(21) Appl. No.: 16/375,439

(22) Filed: Apr. 4, 2019

(65) Prior Publication Data

US 2019/0307189 A1 Oct. 10, 2019

(30) Foreign Application Priority Data

Apr. 6, 2018 (DE) ..... 10 2018 205 187.9

(51) Int. Cl.

| | |
|---|---|
| ***B32B 3/10*** | (2006.01) |
| ***A41D 27/28*** | (2006.01) |
| ***A41D 31/14*** | (2019.01) |
| ***A41D 13/015*** | (2006.01) |

(52) U.S. Cl.

CPC ..... *A41D 27/28* (2013.01); *A41D 13/0158* (2013.01); *A41D 31/14* (2019.02)

(58) Field of Classification Search

CPC .... A41D 27/28; A41D 31/14; A41D 13/0158; A45F 3/04; A45F 3/12; A45F 3/125; A45F 3/14; A45F 3/142; A45F 3/146; A45F 3/148; A45F 2003/122; A45F 2003/125; B32B 3/02; B32B 3/06; B32B 3/12; B32B 3/18; B32B 3/20; B32B 3/22; B32B 3/28; B32B 3/30; C08L 23/0853

USPC ..... 428/131, 132, 134, 179, 181, 182, 183, 428/186

See application file for complete search history.

(56) References Cited

U.S. PATENT DOCUMENTS

| | | | | |
|---|---|---|---|---|
| 3,045,243 | A | 7/1962 | Lash et al. | |
| 6,184,294 | B1 * | 2/2001 | Park | C08L 25/08 525/191 |
| 2006/0083912 | A1 | 4/2006 | Park | |
| 2008/0138565 | A1 | 6/2008 | Yang | |
| 2009/0100578 | A1 | 4/2009 | Coates | |
| 2018/0139922 | A1 * | 5/2018 | Watson | A01K 1/0254 |

FOREIGN PATENT DOCUMENTS

| | | | |
|---|---|---|---|
| EP | 2 937 004 | A1 | 10/2015 |
| EP | 3 398 465 | A1 | 11/2018 |
| WO | WO 2010/035040 | A1 | 4/2010 |
| WO | WO 2014/120867 | A1 | 8/2014 |
| WO | WO 2014/182599 | A1 | 11/2014 |

OTHER PUBLICATIONS

Extended European Search Report issued in European Patent Application No. 19167622.0, dated Aug. 1, 2019, 8 pages.

* cited by examiner

*Primary Examiner* — Zachary M Davis
(74) *Attorney, Agent, or Firm* — Sterne, Kessler, Goldstein & Fox P.L.L.C.

(57) ABSTRACT

The present invention concerns a ventilation element for an article of apparel, footwear, or a sports accessory, including: a first surface, including a foam; a second surface; where the first surface and the second surface are spaced apart, creating a void, so that air may circulate between the first surface and the second surface.

20 Claims, 7 Drawing Sheets

VENTILATION ELEMENT

TECHNICAL FIELD

Figure 1A:
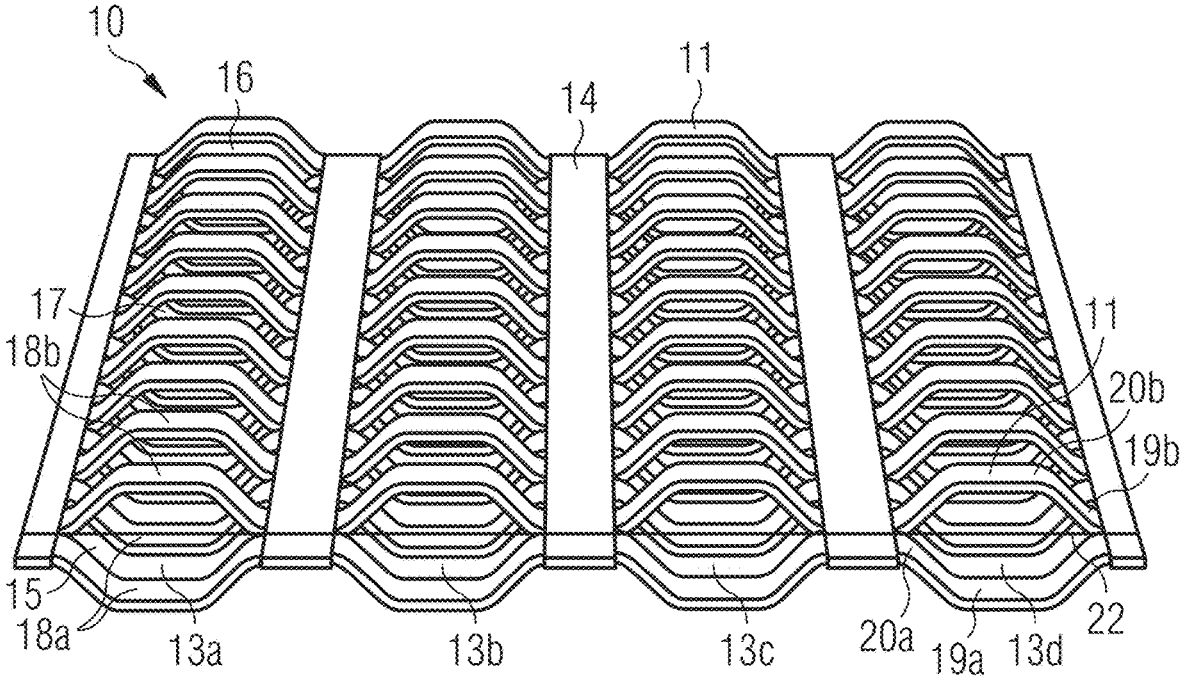

The present invention relates to a ventilation element for an article of apparel or footwear or for a sports accessory.

PRIOR ART

Ventilation elements are ubiquitous in various types of apparel, footwear or in sports accessories. For example, ventilation elements are fitted to the backside of a backpack in order to improve the ventilation of the back of an athlete wearing the backpack.

One known type of ventilation element for a backpack creates a gap between the back of the athlete and the backside of the backpack to improve the circulation of air between the back of the athlete and the backside of the backpack. EP 2 407 050 B1 discloses a frame arrangement concavely tensioning the backwall of a backpack and a net part extending in a sinew-like manner over the concave tensioned back wall. A disadvantage of such a system is the increased weight due to the frame, which is usually made from aluminium, and the complexity of assembly and therefore the increased cost of the backpack. Moreover, the frame itself must necessarily be rigid and so this type of ventilation element does not adapt well to different shapes of a body, for example due to different postures when exercising. This type of ventilation element can also not be used in locations where the ventilation element itself should be elastically stretchable. It may, for example be desired to fit a ventilation element to the straps of a backpack that allows the straps to remain elastically stretchable, for example to absorb shocks that the athlete would otherwise experience from a bouncing backpack, for example during running. Finally, this known construction has the disadvantage that the centre of mass of the backpack is a long distance away from the centre of mass of the athlete, therefore creating an imbalance during exercise.

US 2005/0040684 A1 discloses a cushion member attached to a portion of a bag were a body of user contacts when the bag is used. The cushion member includes an uneven surface portion formed from a plurality of elastic projections. However, the production of the cushion member described by US 2005/0040684 A1 is relatively complicated as it involves molding.

It is therefore an objective underlying the present invention to provide a ventilation element for an article of apparel or footwear or for a sports accessory that is simple to produce, that is adaptable to different body shapes and postures, and that allows shocks to be absorbed.

SUMMARY OF THE INVENTION

This object is accomplished by the teachings of the independent claims and in particular by a ventilation element for an article of apparel, footwear, or a sports accessory, comprising: a first surface, comprising a foam; a second surface; wherein the first surface and the second surface are spaced apart, creating a void, so that air may circulate between the first surface and the second surface.

An article of apparel may, for example, be a pair of trousers, shorts, a shirt, a jacket, or a top. An article of footwear may be a shoe, for example a running shoe, a tennis shoe, or a football boot. A sports accessory may be a backpack, a protective element such as a shinguard, a knee protector, an elbow protector, or a shoulder protector.

The first surface may contact a body part (or clothing, e.g. a shirt, worn by an athlete) directly or indirectly during normal use of the article of apparel, footwear, or the sports accessory. The second surface may contact a contacting portion of the article of apparel, footwear, or the sports accessory during normal use. A contacting portion may be any portion of the article of apparel, footwear, or the sports accessory. For example, for a backpack, a contacting portion may be a backside of the backpack that would, during normal use, be in contact with the back of the athlete. A contacting portion may also be a side of a strap of a backpack that, during normal use, would contact part of the shoulders or upper body of an athlete wearing the backpack. It is not necessary that the ventilation element is arranged between the contacting portion and the body part during normal use. Therefore, the first surface may only indirectly contact the body part. However, it is possible that the ventilation element is arranged between the contacting portion and the body part (or clothing, e.g. a shirt, worn by an athlete) during normal use.

It is to be understood that the spacing between the first surface and the second surface is to be determined in an equilibrium state, without the application of any force, apart from gravity.

The void is the entire space created by spacing apart the first surface and the second surface. The spacing is determined as the spacing between a plane in which the first surface is located and a plane in which the second surface is located. In other words, a lateral separation between the first surface and the second surface is not considered to add to the spacing between the first surface and the second surface. The minimum spacing between the first surface and the second surface is considered to be the sum of the thickness of the first surface and the thickness of the second surface. At this minimum spacing, there is no void. The void may or may not be one connected region.

The ventilation element according to the present invention is lightweight, cushioning, and adaptable since it comprises a foam. The foam may be elastic. Moreover, air may circulate between the first surface and the second surface, providing a comfortable level of ventilation to the athlete.

The first surface may have a first surface area and the second surface may have a second surface area and the ratio of the first surface area and the second surface area may be between 0.2 and 5, preferably between 0.5 and 2, most preferably between 0.75 and 1.33. A small first surface area, compared to the second surface area, leads to better ventilation properties. However, there is a trade-off because for a heavy article of apparel, footwear, or a sports accessory, a first surface area that is too small may be not sufficiently strong to support the weight of the article of apparel, footwear, or sports accessory. The inventors have found that a ratio not too far from unity provides ideal ventilation and stability.

The first surface and the second surface may be arranged to form a first channel in the void. The first channel may be arranged substantially along a longitudinal direction of the ventilation element. For example, for a backpack, a longitudinal direction may be essentially along a vertical direction when the backpack is worn in an upright posture. Essentially along a vertical direction means in this context, extending in the direction from a bottom end of the backpack to a top end of the backpack but allowing for a sideways deviation of up to 30°, preferably 20°.

The inventors have found that the dynamic movement of the athlete causes a chimney effect in the first channel, thus substantially improving the ventilation provided by the ventilation element. For example, the dynamic movement of the athlete, combined with the cushioning and elastic properties of the foam, may cause the spacing between the first surface and the second surface to vary dynamically during use, thereby creating a "breathing" effect.

The first channel may extend substantially from one end of the article of apparel, footwear, or the sports accessory to another end. For example, the first channel may extend substantially from a bottom end to a top end. "Substantially" in this context means at least 60% of the length, preferably 80%, most preferably 90%.

The first channel may have a first width at a first end, a second width at a second end, and a third width at a location between the first end and the second end. For example, the first channel may have a third width at a location arranged in the middle between the first end and the second end.

The first width may be greater than the third width and the second width may be greater than the third width. The inventors have found, that this improves the ventilation provided by the ventilation element as the air circulation is improved by a greater capability for air intake and exhaust at the first end and the second end. At the same time, it is advantageous if the second width is smaller than the first width and the third width, as it improves the adaptability of the ventilation element. Generally, the width of the first channel is to be measured in a direction perpendicular to a longitudinal direction of the channel and in a plane parallel to the first surface.

The ventilation element may comprise a second channel. The second channel may have the same properties as the first channel described herein. The inventors have found, that the ventilation properties and the adaptability of the ventilation element is improved by forming a second channel. In general, the ventilation element may comprise any number of channels.

The second channel may be substantially parallel to the first channel. Substantially parallel in this context means within an angle of +/−10°. Arranging the second channel substantially parallel to the first channel simplifies the construction of the ventilation element.

The first channel may be arranged at a first distance from the second channel at a first end, a second distance from the second channel at a second end, and a third distance from the second channel at a location between the first end and the second end. For example, the first channel may be arranged at a third distance from the second channel at a location in the middle between the first end and the second end. The first distance and the second distance may be greater than the third distance. In other words, the distance between the first channel and the second channel is greater at the first end and the second end than at a location in between the first end and the second end. Therefore, the first channel and the second channel may not be substantially parallel to each other. In this arrangement, a first angle that the first channel makes with a vertical direction at the first end of the first channel may be different to a second angle that the first channel makes with the vertical direction at the second end of the first channel. The inventors have found, that this arrangement improves the ventilation provided by the ventilation element. The reason for this is that this arrangement provides a range of angles for air intake and exhaust. When the athlete is moving dynamically, a greater range of angles for air intake and exhaust therefore improves the ventilation properties of the ventilation element.

The ventilation element may comprise a first bridge and a second bridge; wherein the first surface is an outward-facing surface of the first bridge and the second surface is an inward-facing surface of the second bridge. A bridge in the present context is any construction comprising a low portion and a raised portion. The separation of the low portion and the raised portion, measured from outer surface to outer surface, is referred to as the height of the bridge. The first surface may be an outward-facing surface of the raised portion of the first bridge. The second surface may be an inward-facing surface of a low portion of the second bridge. The inventors have found that this construction is simple to produce, easily adapts to different body shapes and postures, and provides good ventilation and cushioning.

The first bridge and the second bridge may be arranged adjacent to each other. In particular, the low portion of the first bridge may be arranged at the same level as the raised portion of the second bridge. In this case, the spacing between the first surface and the second surface is given by the sum of the height of the first bridge plus the height of the second bridge plus the thickness of the raised portion of the first bridge plus the thickness of the low portion of the second bridge.

It is advantageous to arrange the first bridge adjacent to the second bridge as it allows a simple geometry to be constructed in which air may flow in all three spatial directions thus improving the ventilation properties of the ventilation element.

The first bridge may extend outwards and the second bridge may extend inwards. Outwards means in this case towards the body part and inwards means in this case towards the article of apparel, or footwear, or the sports accessory.

The arrangement of the first and the second bridge may be symmetrical. The ventilation element may comprise a symmetry axis, and the second bridge may be essentially identical to the first bridge but rotated by 180° around the symmetry axis. Essentially identical means in this case the height of the first bridge and height of the second bridge may not be identical. Generally, however, the height of the first bridge and the height of the second bridge may be identical. Moreover, some other differences may result from manufacturing imperfections.

The ventilation element may comprise a plurality of first bridges and a plurality of second bridges arranged to extend outwards and inwards in an alternating manner.

Such an arrangement of a first bridge and a second bridge is particularly simple to produce and provides excellent ventilation uniformly throughout the ventilation element.

A spacing along an outward-facing direction between the first surface and the second surface may be at least 0.5 cm and no more than 5 cm, preferably at least 1 cm and no more than 3 cm. Generally, the larger this spacing is, the better is the circulation of air and therefore the better of ventilation properties of the ventilation element. However, a larger spacing also implies a larger spacing between the centre of mass of the article of apparel of footwear all the sports accessory, for example the centre of mass of a backpack, and the centre of mass of the athlete wearing the article of apparel or footwear or carrying the sports accessory. This may create an imbalance and may be ergonomically undesirable.

A thickness of the first bridge and/or the second bridge may be between 0.5 mm and 20 mm, preferably between 1 mm and 10 mm, most preferably between 2 mm and 5 mm. The thickness affects the bending stiffness of the first bridge/second bridge. The thicker the first bridge/second bridge, the larger is the bending stiffness for bending in the direction of the thickness. If the bending stiffness is too great, the ventilation element does not adapt well to different body shapes or postures. The thickness also affects the cushioning properties of the ventilation element. The thicker the first bridge/second bridge, the better the cushioning properties of the first bridge/second bridge. Therefore, there is a trade-off between bending stiffness on the one hand and cushioning properties on the other hand.

The second surface may also comprise the foam. While the second surface may not normally be in contact with the body part of the athlete, the overall cushioning properties are improved if the second surface also comprises the foam.

The foam may comprise a thermoplastic polymer. A thermoplastic polymer is a polymer that melts or softens under application of heat. A foam comprising a thermoplastic polymer is lightweight, cushioning, and may be easily manufactured.

The foam may have a hardness of 10-80 Shore A, preferably 20-60 Shore A, most preferably 50-60 Shore A. The hardness of the foam is an important criterion for determining its cushioning abilities. If the foam is too hard, the ventilation element is uncomfortable. However, if the foam is too soft, then when a load is applied to the ventilation element, for example due to the dynamic movement of an athlete during exercise or due to the weight of the article of apparel, footwear or the sports accessory, the foam will be compressed to easily leading to a deterioration in the ventilation properties. For example, the spacing between the first surface and the second surface may be reduced to much, if the foam is too soft.

The foam may have a density of between 25 and 400 kg per cubic meter, preferably between 50 and 250 kg per cubic meter, most preferably between 150 and 200 kg per cubic meter. The density of the foam determines its weight, for a given volume. Therefore, generally a denser foam will also be heavier. However, the density of the foam also determines its abrasion resistance. A denser foam will generally be more resistant to abrasion.

The foam may have an elongation at break of at least 50%, preferably at least 75%, most preferably at least 150%. Especially for sports use, it is preferable for the foam to have a large elongation at break. This way, the ventilation element may help to absorb shocks resulting from the dynamic movement of the athlete without tearing or breaking.

The foam may have an elastic modulus of 1 to 100 MPa, preferably between 1 and 5 MPa, most preferably between 1 and 2 MPa. The elastic modulus, also known as Young's modulus indicates how stretchable, or elastic, material is. A large elastic modulus indicates a low level of elasticity, while a small elastic modulus indicates a high level of elasticity. Especially for sports use, it is preferable for the foam to have a relatively small elastic modulus. This way, the ventilation element may help to absorb shocks resulting from the dynamic movement of the athlete.

The foam may comprise ethyl vinyl acetate, also known as EVA. EVA may be thermoformed in an accessible temperature range and the ventilation element is therefore easy to produce.

The ventilation element may be a single unitary piece. This way, the construction of the ventilation element the simplified and there are no potential weak spots at which different elements are joined, thus improving the stability of the ventilation element.

The sports accessory may be a backpack and the ventilation element may comprise a recess arranged along a longitudinal direction of the backpack. The recess may be for receiving a portion of the spine that protrudes from the back of the athlete. The wearing comfort of the ventilation element is improved, since it may not directly contact the spine. Preferably the recess is at least 20 cm long, more preferably at least 30 cm. Preferably, the recess is at least 2 cm wide, more preferably at least 4 cm. This way, even during dynamic movement of the athlete, the ventilation element may generally not be in direct contact with the spine.

The invention further concerns an article of apparel, footwear, or a sports accessory comprising a ventilation element as described herein. The article of apparel, footwear or the sports accessory benefits from the advantageous features of the ventilation element described herein.

The invention further concerns a method of producing a ventilation element for an article of apparel, footwear, or a sports accessory, comprising:

forming a first surface, comprising a foam;

forming a second surface; forming a spacing between the first surface and the second surface to create a void, so that air may circulate between the first surface and the second surface.

The present invention provides a simple method for producing a ventilation element that is lightweight, cushioning, and adaptable. Moreover, air may circulate between the first surface and the second surface, providing a comfortable level of ventilation to the athlete.

The first surface may have a first surface area and the second surface may have a second surface area and the first surface and the second surface may be formed such that the ratio of the first surface area and the second surface area is between 0.2 and 5 preferably between 0.5 and 2, most preferably between 0.75 and 1.33. A small first surface area, compared to the second surface area, leads to better ventilation properties. However, there is a trade-off because for a heavy article of apparel, footwear, or a sports accessory, a first surface area that is too small may be not sufficiently strong to support the weight of the article of apparel, footwear, or sports accessory. The inventors have found that a ratio not too far from unity provides ideal ventilation and stability.

Forming a spacing between the first surface and the second surface may comprise the application of heat and/or pressure. Such a method may be described as thermoforming. For example, a sheet of foam may be pressed and heated in a form in order to form a spacing between the first surface and the second surface. This method has the advantage that lower temperatures may be used then, for example in injection molding.

Forming a spacing between the first surface and the second surface to create a void may comprise forming a first channel. The first channel may be arranged substantially along a longitudinal direction of the ventilation element. For example, for a backpack, a longitudinal direction may be essentially along a vertical direction. Essentially along a vertical direction means in this context, extending in the direction from a bottom end of the backpack to a top end of the backpack but allowing for a sideways deviation of up to 30°, preferably 20°.

The inventors have found that the dynamic movement of the athlete causes a chimney effect in the first channel, thus substantially improving the ventilation provided by the ventilation element. For example, the dynamic movement of the athlete, combined with the cushioning and elastic properties of the foam, may cause the spacing between the first surface and the second surface to vary dynamically during use, thereby creating a "breathing" effect.

The method may comprise extending the first channel substantially from one end of the article of apparel, footwear, or the sports accessory to another end. For example, the first channel may extend substantially from a bottom end to the top end. "Substantially" in this context means at least 60% of the length, preferably 80%, most preferably 90%.

The first channel may have a first width at a first end, a second width at a second end, and a third width at a location between the first end and the second end. For example, the first channel may have a third width at a location arranged in the middle between the first end and the second end.

The first width may be greater than the third width and the second width may be greater than the third width. The inventors have found, that this improves the ventilation provided by the ventilation element as the air circulation is improved by a greater capability for air intake and exhaust at the first end and the second end. At the same time, it is advantageous if the second width is smaller than the first width and the third width, as it improves the adaptability of the ventilation element. Generally, the width of the first channel is to be measured in a direction perpendicular to a longitudinal direction of the channel and in a plane parallel to the first surface.

The method may further comprise, forming a second channel in the ventilation element. The second channel may have the same properties as the first channel described herein. The inventors have found, that the ventilation properties and the adaptability of the ventilation element is improved by forming a second channel.

The method may comprise arranging the second channel to be substantially parallel to the first channel. Substantially parallel in this context means within an angle of +/−10°. Arranging the second channel substantially parallel to the first channel simplifies the construction of the ventilation element. In general, the ventilation element may comprise any number of channels.

The method may comprise arranging the first channel at a first distance from the second channel at a first end, a second distance from the second channel at a second end, and a third distance from the second channel at a location between the first end and the second end. For example, the first channel may be arranged at a third distance from the second channel at a location in the middle between the first end and the second end. The first distance and the second distance may be greater than the third distance. In other words, the distance between the first channel and the second channel is greater at the first end and the second end than at a location in between the first end and the second end. Therefore, the first channel and the second channel may not be substantially parallel to each other. In this arrangement, a first angle that the first channel makes with a vertical direction at the first end of the first channel may be different to a second angle that the first channel makes with the vertical direction at the second end of the first channel. The inventors have found, that this arrangement improves the ventilation provided by the ventilation element. The reason for this is that this arrangement provides a range of angles for air intake and exhaust. When the athlete is moving dynamically, a greater range of angles for air intake and exhaust therefore improves the ventilation properties of the ventilation element.

Forming a first surface may comprise forming a first bridge, wherein the first surface is an outward-facing surface of the first bridge; and wherein forming a second surface comprises forming a second bridge, wherein the second surface is an inward-facing surface of the second bridge. A bridge in the present context is any construction comprising a low portion and a raised portion. The separation of the low portion and the raised portion, measured from outer surface to outer surface, is referred to as the height of the bridge. The first surface may be an outward-facing surface of the raised portion of the first bridge. The second surface may be an inward-facing surface of a low portion of the second bridge. The inventors have found that this construction is simple to produce, easily adapts to different body shapes and postures, and provides good ventilation and cushioning.

The method may further comprise arranging the first bridge and the second bridge adjacent to each other. In particular, the low portion of the first bridge may be arranged at the same level as the raised portion of the second bridge. In this case, the spacing between the first surface and the second surface is given by the sum of the height of the first bridge plus the height of the second bridge plus the thickness of the raised portion of the first bridge plus the thickness of the low portion of the second bridge.

It is advantageous to arrange the first bridge adjacent to the second bridge as it allows a simple geometry to be constructed in which air may flow in all three spatial directions thus improving the ventilation properties of the ventilation element.

Forming a first bridge may comprise forming the first bridge to extend outwards and forming the second bridge may comprise forming the second bridge to extend inwards. Outwards means in this case towards the body part and inwards means in this case towards the article of apparel, or footwear, or the sports accessory.

The first and the second bridge may be formed symmetrically. The ventilation element may be formed to comprise a symmetry axis, and the second bridge may be formed essentially identically to the first bridge but rotated by 180° around the symmetry axis. Essentially identically means in this case that the height of the first bridge and the height of the second bridge may not be identical. However, the height of the first bridge and the height of the second bridge may be identical. Moreover, some other differences may result from manufacturing imperfections.

The ventilation element may be formed to comprise a plurality of first bridges and a plurality of second bridges arranged to extend outwards and inwards in an alternating manner.

Such an arrangement of a first bridge and a second bridge is particularly simple to produce and provides excellent ventilation uniformly throughout the ventilation element.

The second surface may also comprise the foam and forming the first bridge and the second bridge may comprise making a cut in a sheet comprising the foam. While the second surface may not normally be in contact with the body part of the athlete, the overall cushioning properties are improved if the second surface also comprises the foam. Moreover, this allows a simple production of the ventilation element that does not require an injection molding setup. Cutting may be performed by die cutting or laser cutting.

A spacing along an outward-facing direction between the first surface and the second surface may be at least 0.5 cm and no more than 5 cm, preferably at least 1 cm and no more than 3 cm. The advantages of this construction have been explained herein with respect to the ventilation element.

A thickness of the first bridge and/or the second bridge may be between 0.5 mm and 20 mm, preferably between 1 mm and 10 mm, most preferably between 2 mm and 5 mm. The advantages of this thickness have been explained herein with respect to the ventilation element.

The foam may comprise a thermoplastic polymer. A thermoplastic polymer is a polymer that melts or softens under application of heat. A foam comprising a thermoplastic polymer is lightweight, cushioning, and may be easily manufactured.

The foam may have a hardness of 10-80 Shore A, preferably 20-60 Shore A, most preferably 50-60 Shore A. The advantages of this hardness have been explained herein with respect to the ventilation element.

The foam may have a density of between 25 and 400 kg per cubic meter, preferably between 50 and 250 kg per cubic meter, most preferably between 150 and 200 kg per cubic meter. The advantages of this density have been explained herein with respect to the ventilation element.

The foam may have an elongation at break of at least 50%, preferably at least 75%, most preferably at least 150%. The advantages of this elongation have been explained herein with respect to the ventilation element.

The foam may have an elastic modulus of 1 to 100 MPa, preferably between 1 and 5 MPa, most preferably 1 to 2 MPa. The advantages of this elastic modulus have been explained herein with respect to the ventilation element.

The foam may comprise ethyl vinyl acetate, also known as EVA. EVA may be thermoformed in an accessible temperature range and the ventilation element is therefore easy to produce.

The ventilation element may be formed as a single unitary piece. This way, the construction of the ventilation element the simplified and there are no potential weak spots at which different elements are joined, thus improving the stability of the ventilation element.

The invention further concerns a method of producing an article of apparel, footwear, or a sports accessory, comprising producing a ventilation element for the article of apparel, footwear, or the sports accessory, as described herein. The article of apparel, footwear or the sports accessory benefits from the advantageous features of the ventilation element described herein.

SHORT DESCRIPTION OF THE FIGURES

In the following, exemplary embodiments of the invention are described with reference to the figures. The figures show:

FIGS. 1A-D: an exemplary ventilation element according to the present invention.

Figure 2:
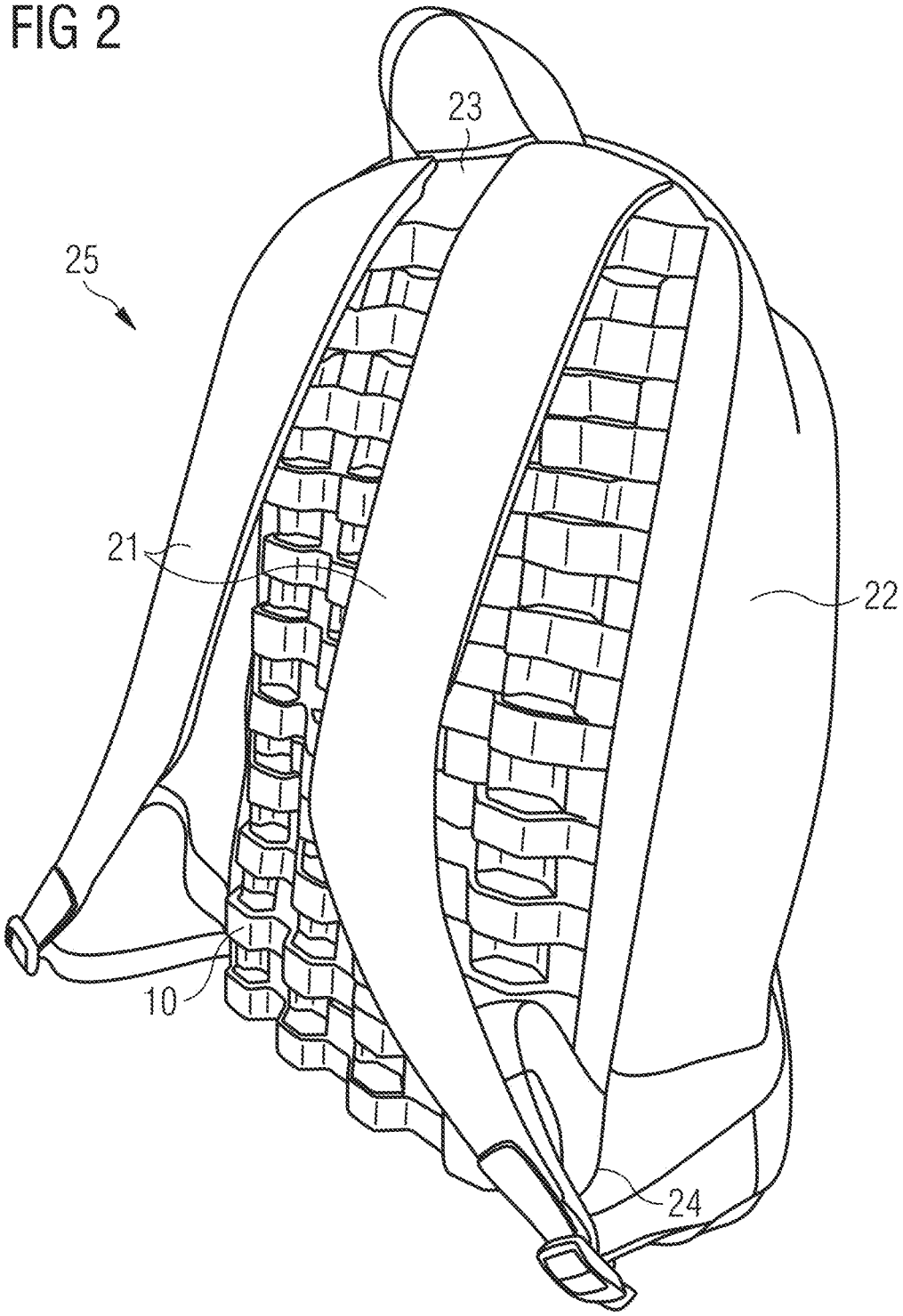
Figure 3A:
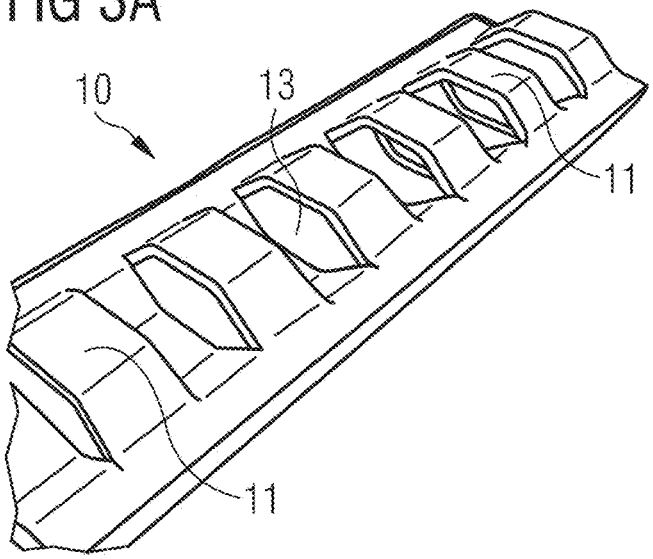
Figure 3B:
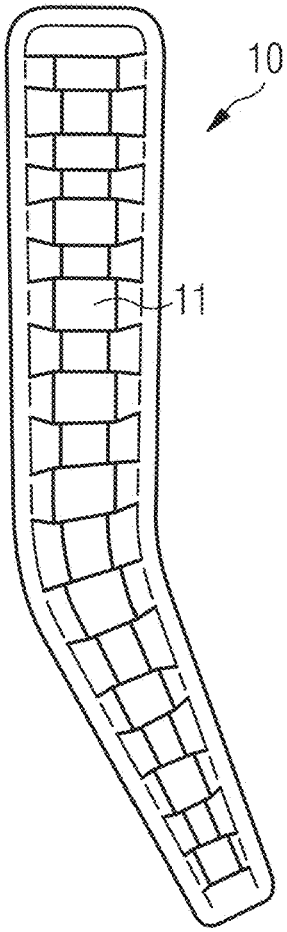
Figure 3C:
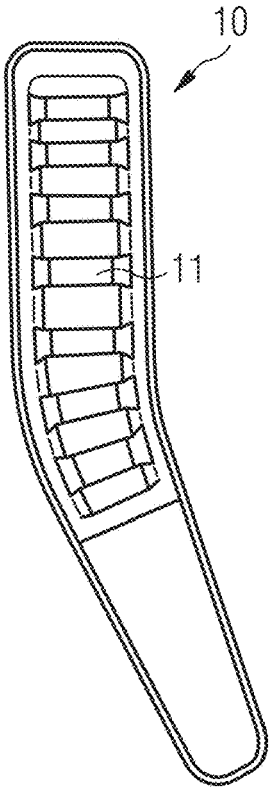
Figure 3D:
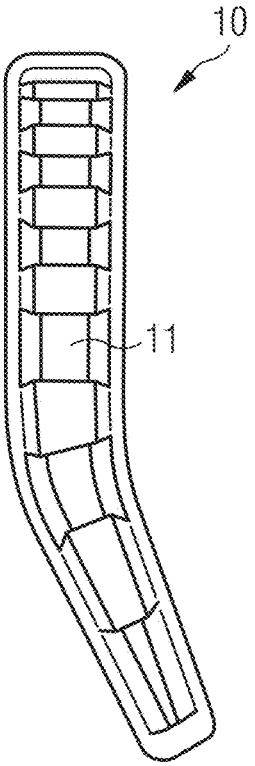

FIG. 2: an exemplary backpack according to the present invention.

FIGS. 3A-D: another exemplary ventilation element according to the present invention.

Figure 4A:
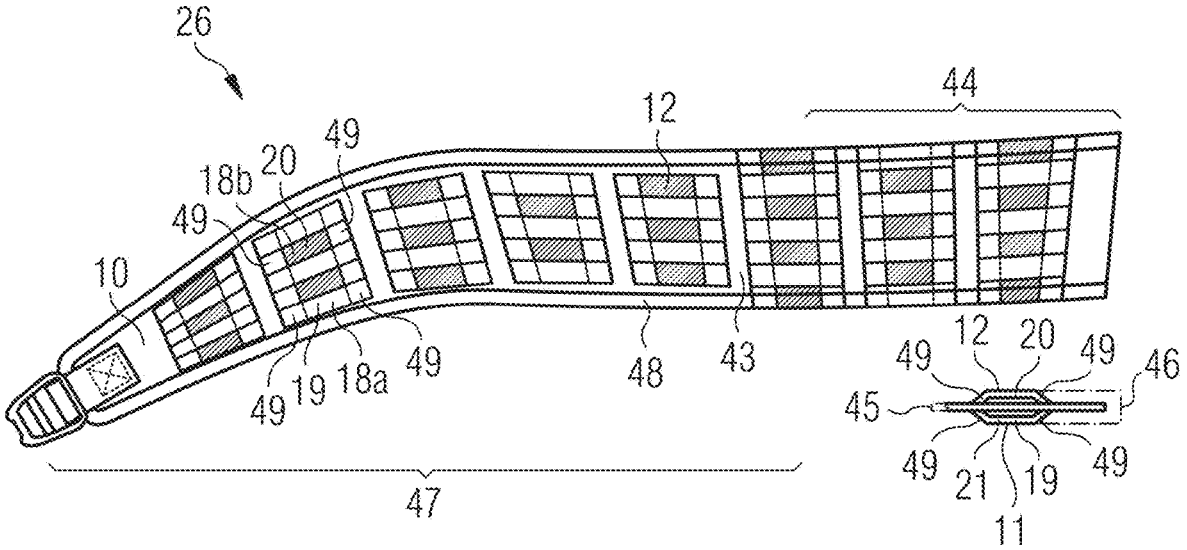
Figure 4B:
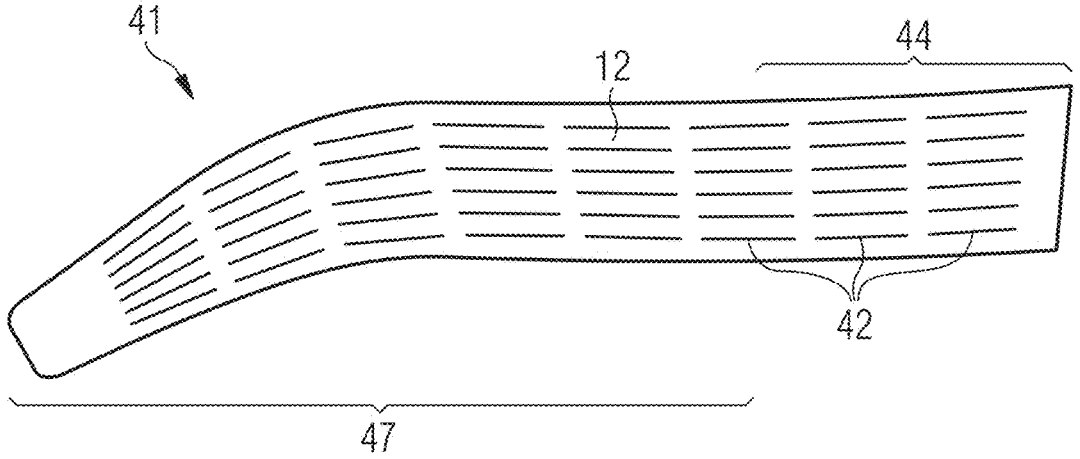
Figure 4C:
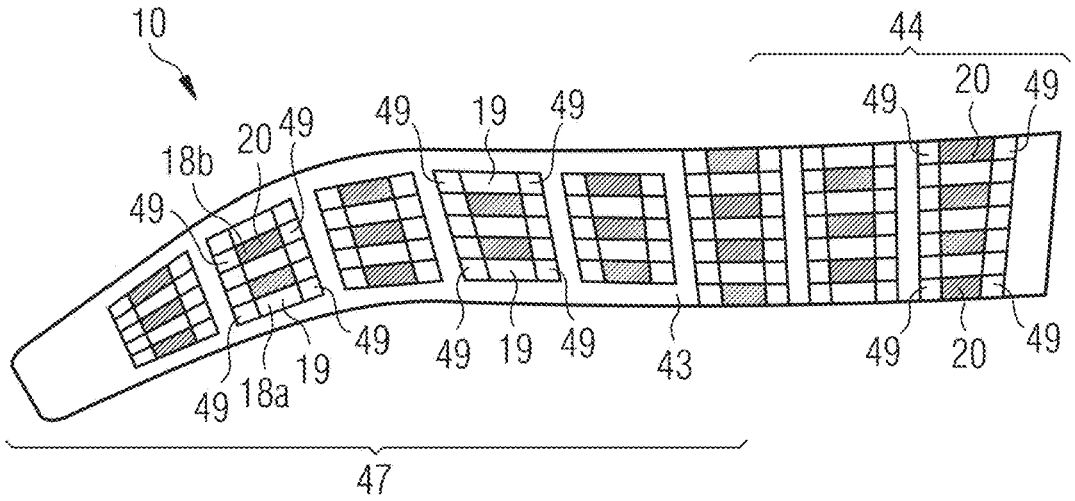

FIGS. 4A-4C: an exemplary ventilation element for a shoulder strap and a method for producing the same according to the present invention.

Figure 5:
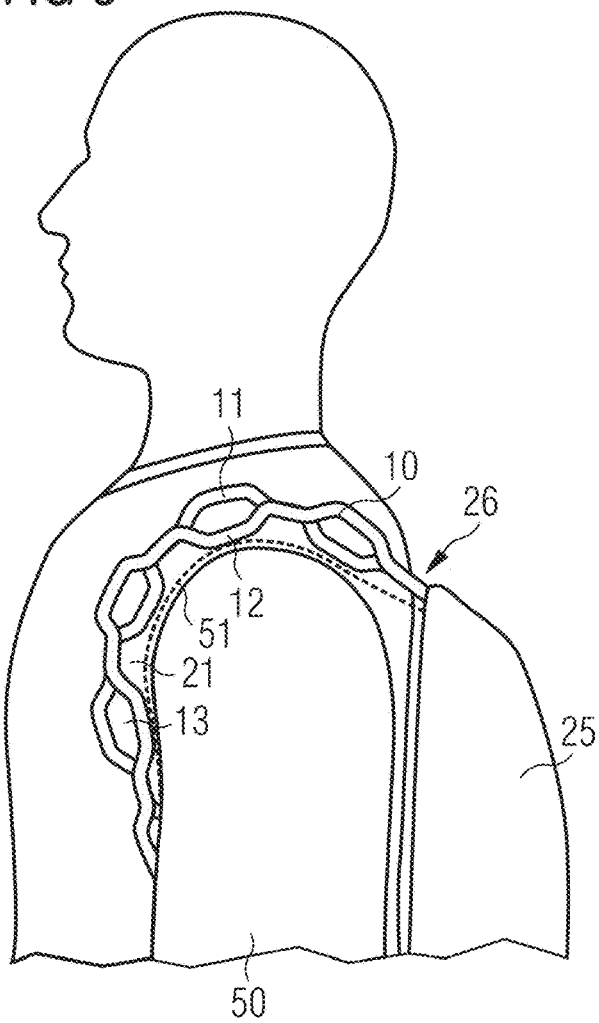

FIG. 5: an exemplary ventilation element for a shoulder strap according to the present invention.

DETAILED DESCRIPTION OF PREFERRED EMBODIMENTS

In the following only some possible embodiments of the invention are described in detail. It is to be understood that these exemplary embodiments can be modified in a number of ways and combined with each other whenever compatible and that certain features may be omitted in so far as they appear dispensable.

FIGS. 1A-D show an exemplary ventilation element 10 according to the present invention. The ventilation element 10 is for an article of apparel, footwear, or a sports accessory. The ventilation element 10 comprises: a first surface 11, comprising a foam; a second surface 12; wherein the first surface 11 and the second surface 12 are spaced apart, creating a void, so that air may circulate between the first surface and the second surface.

In this example, the first surface 11 contacts a body part directly during normal use of the article of apparel, footwear, or the sports accessory. The second surface 12 contacts a contacting portion of the article of apparel, footwear, or the sports accessory during normal use. A contacting portion may be any portion of the article of apparel, footwear, or the sports accessory. In this example, a contacting portion may be a backside of a backpack that would, during normal use, be in contact with the back of the athlete (see also FIG. 2). A contacting portion may also be a side of a strap of a backpack that, during normal use, would contact part of the shoulders or upper body of an athlete wearing the backpack.

In this example, the ventilation element 10 is arranged between the contacting portion and the body part during normal use. However, it is not necessary that the ventilation element 10 is arranged between the contacting portion and the body part during normal use.

Figure 1B:
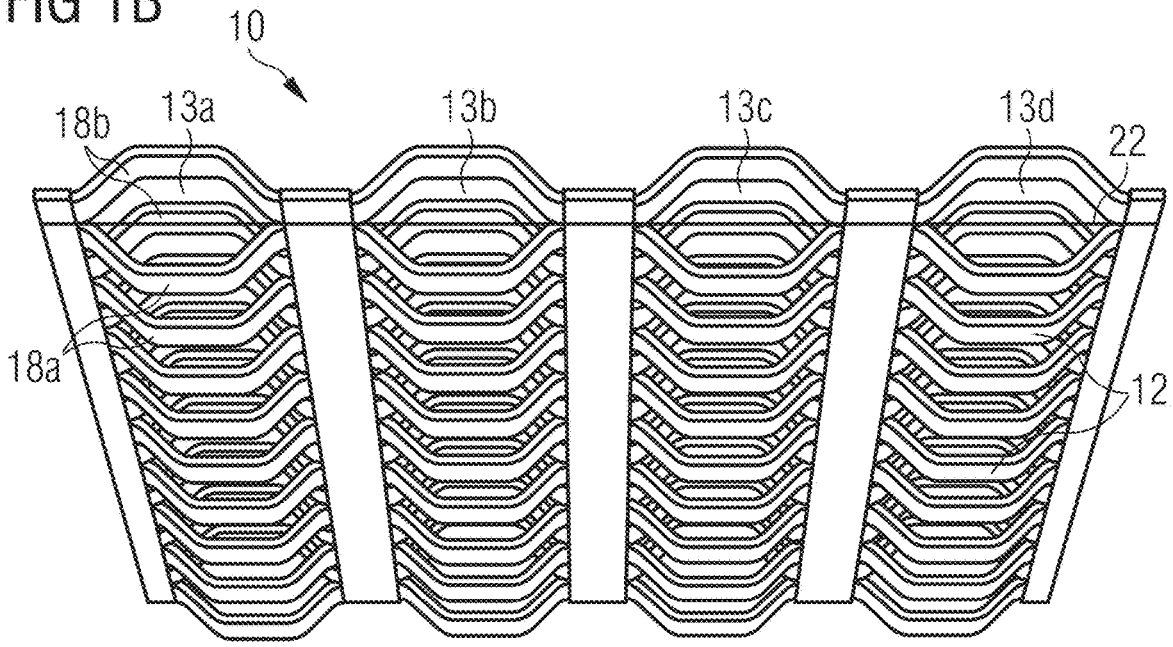

FIG. 1A shows a top view of the ventilation element 10. Part of the side of the ventilation element 10 shown in FIG. 1A would normally be in contact with the body part. FIG. 1B shows a bottom view of the ventilation element 10. Part of the side of the ventilation element 10 shown in FIG. 1B would normally be in contact with the contacting portion of the article of apparel or footwear or the sports accessory.

The first surface 11 has a first surface area and the second surface 12 (shown in FIG. 1B) has a second surface area and the first surface and the second surface are formed such that the ratio of the first surface area and the second surface area is between 0.9, i.e. the first surface area is 90% of the second surface area.

The first surface 11 and the second surface 12 are arranged to form a first channel 13*a* in the void. The first channel 13*a* has a first width at a first end 15, a second width at a second end 16, and a third width at a location 17 between the first end 15 and the second end 16. In this example, the first channel 13*a* has a third width at a location 17 arranged in the middle between the first end 15 and the second end 16. In this example, the first, second, and third width of the first channel 13*a* are identical. However, it is possible that the first width may be greater than the third width and the second width may be greater than the third width.

The ventilation element 10 comprises a second channel 13*b*. The second channel 13*b* has the same properties as the first channel 13*a* described herein. In this example, the ventilation element 10 also comprises a third channel 13*c* and a fourth channel 13*d*. In this example, the second channel 13*b* is substantially parallel to the first channel 13*a*.

Figure 1C:
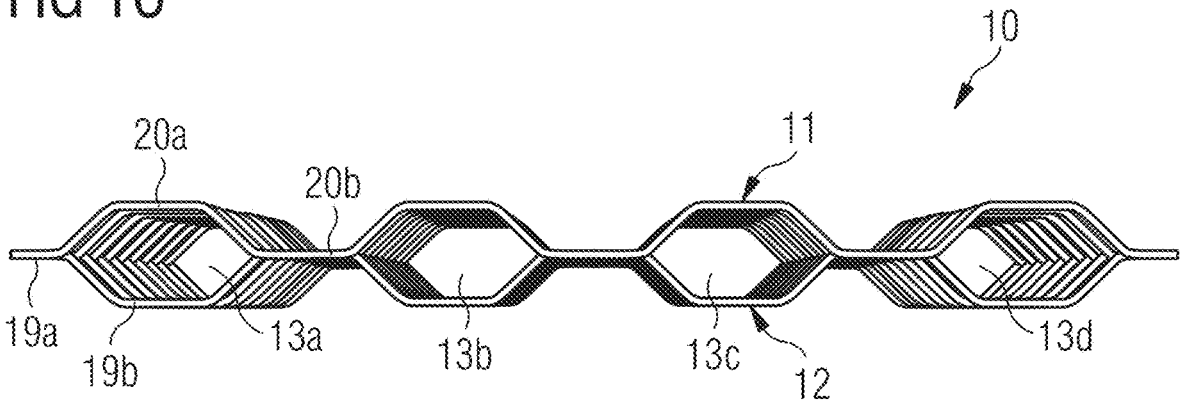

The first channel 13*a* is arranged at a first distance from the second channel 13*b* at a first end 15, a second distance from the second channel 13*b* at a second end 16, and a third distance from the second channel 13*b* at a location 17 between the first end 15 and the second end 16. In this example, the first channel 13*a* is arranged at a third distance from the second channel 13*b* at a location 17 in the middle between the first end 15 and the second end 16. In the example of FIGS. 1A-C, the first, second, and third distance are identical. However, in other embodiments the first distance and the second distance may be greater than the third distance. In other words, the distance between the first channel 13*a* and the second channel 13*b* is greater at the first end 15 and the second end 16 than at a location 17 in between the first end 15 and the second end 16. Therefore, the first channel 13*a* and the second channel 13*b* may not be substantially parallel to each other.

The ventilation element 10 comprises a first bridge 18*a* and a second bridge 18*b*; wherein the first surface 11 is an outward-facing surface of the first bridge 18*a* and the second surface 12 is an inward-facing surface of the second bridge 18*b*. A bridge in the present context is any construction comprising a low portion and a raised portion. The first surface 11 is an outward-facing surface of the raised portion 20*a* of the first bridge 18*a*. The second surface 12 is an inward-facing surface of a low portion 19*b* of the second bridge 18*b*.

The first bridge 18*a* and the second bridge 18*b* are arranged adjacent to each other. In particular, the low portion 19*a* of the first bridge 18*a* are arranged at the same level as the raised portion 20*b* of the second bridge 18*b*.

The first bridge 18*a* extends outwards and the second bridge 18*b* extends inwards. Outwards means in this case towards the body part and inwards means in this case towards the article of apparel, or footwear, or the sports accessory.

In this example, the arrangement of the first 18*a* and the second 18*b* bridge is symmetrical. The ventilation element 10 comprises a symmetry axis 22, and the second bridge 18*b* is essentially identical to the first bridge 18*a* but rotated by 180° around the symmetry axis 22. Essentially identical means in this case the height of the first bridge 18*a* and height of the second bridge 18*b* may not be identical. However, in this example, the height of the first bridge 18*a* and the height of the second bridge 18*b* is identical. Moreover, some other differences may result from manufacturing imperfections.

The ventilation element 10 comprise a plurality of first bridges 18*a* and a plurality of second bridges 18*b* arranged to extend outwards and inwards in an alternating manner.

Such an arrangement of a first bridge 18*a* and a second bridge 18*b* is particularly simple to produce and provides excellent ventilation uniformly throughout the ventilation element 10.

In this example, a spacing along an outward-facing direction between the first surface 11 and the second surface 12 is 2 cm. A thickness of the first bridge 18*a* and the second bridge 18*b* may be 5 mm.

The second surface 12 also comprises the foam. The foam comprises a thermoplastic polymer. The foam has a hardness of 50 Shore A. The hardness may, for example, be measured according to DIN 53505 in the version of the standard valid on Jan. 1, 2018, or according to DIN ISO 7619-1 in the version of the standard valid on Jan. 1, 2018, or according to ASTM 2240 in the version of the standard valid on Jan. 1, 2018. There may be small differences in the value of the hardness determined according to these different standards that are not pertinent to the technical effects described herein.

In this example, the foam has a density of 50 kg per cubic meter, which may be determined by any suitable method. The foam has an elongation at break of 150%. The foam has an elastic modulus of 2 MPa. The foam comprises ethyl vinyl acetate, also known as EVA. However, in other embodiments, these values may be different.

In this example, the ventilation element 10 is for a backpack 25 and the ventilation element 10 comprises a recess 14 to be arranged along a longitudinal direction of the backpack 25. The recess 14 is for receiving a portion of the spine that protrudes from the back of the athlete. The wearing comfort of the ventilation element 10 is improved, since it may not directly contact the spine. In this example, the recess 14 is 30 cm long and 4 cm wide. This way, even during dynamic movement of the athlete, the ventilation element 10 may generally not be in direct contact with the spine.

In this example, the ventilation element 10 is formed as a single unitary piece. Forming a spacing between the first surface 11 and the second surface 12 comprises the application of heat and pressure. Such a method may be described as thermoforming. In this example, a sheet of the foam is pressed and heated in a form in order to form a spacing between the first surface 11 and the second surface 12.

Forming the first bridge 18*a* and the second bridge 18*b* comprises making a cut in a sheet comprising the foam. This allows a simple production of the ventilation element 10 that does not require an injection molding setup. Cutting may be performed by die cutting or laser cutting.

FIG. 1C shows a lateral view of the ventilation element 10 shown in FIGS. 1A and 1B, showing in particular the first 13*a*, second 13*b*, third 13*c*, and fourth 13*d* channel. The first surface 11 is located at the top, while the second surface 12 is located at the bottom.

Also shown is the low portion 19*a* of the first bridge 18*a*, the low portion 19*b* of the second bridge 18*b*, the raised portion 20*a* of the first bridge 18*a*, and the raised portion 20*b* of the second bridge 18*b*. The first surface 11 is an outward-facing surface of the raised portion 20*a* of the first bridge 18*a*. The second surface 12 is an inward-facing surface of a low portion 19*b* of the second bridge 18*b*. In this example, the low portion 19*a* of the first bridge 18*a* are arranged at the same level as the raised portion 20*b* of the second bridge 18*b*.

Figure 1D:
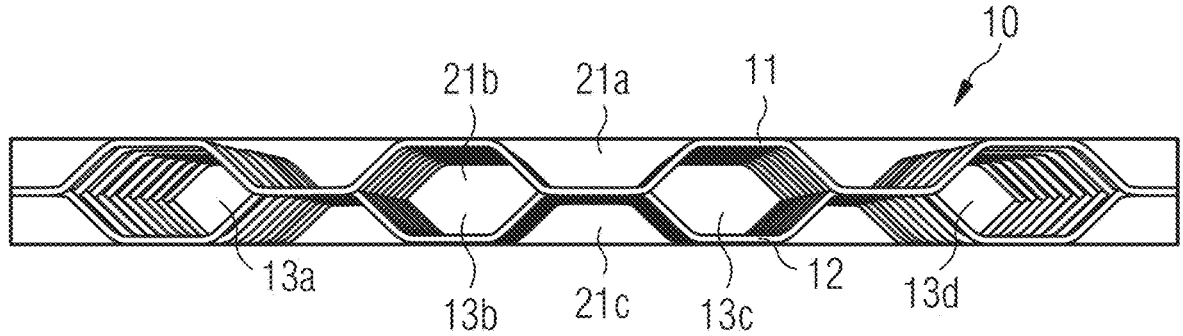

FIG. 1D illustrates in particular the relationship between the void 21 and the channels 13*a-d*. The void 21 is the entire space created by spacing apart the first surface 11 and the second surface 12. The spacing is determined as the spacing between a plane in which the first surface 11 is located and a plane in which the second surface 12 is located. In other words, a lateral separation between the first surface 11 and the second surface 12 is not considered to add to the spacing between the first surface 11 and the second surface 12. The minimum spacing between the first surface 11 and the second surface 12 is considered as the sum of the thickness of the first surface 11 and the thickness of the second surface 12. At this minimum spacing, there is no void 21. The void 21 may or may not be one connected region. In this example, the void 21 is one connected region. The void comprises for example void parts 21*a*, 21*b*, 21*b*. Void part 21*a* is connected to void parts 21*b* and 21*c*. Void part 21*b* is the channel 13*b*. Void parts 21*a* and 21*c* are located between the second channel 13*b* and the third channel 13*c*.

FIG. 2 shows an exemplary sports accessory according to the present invention. In this example, the sports accessory is a backpack 25. The backpack 25 comprises two shoulder straps 26, a top end 23, a bottom end 24, and a main compartment 27. The backpack 25 also comprises a ventilation element 10 according to the present invention. In particular, the ventilation element 10 serves as a back panel of the backpack 25.

In this exemplary ventilation element 10, the first surface 11 and the second surface 12 are arranged to form a first channel 13*a* in the void. The first channel 13*a* is arranged substantially along a longitudinal direction of the ventilation element 10. A longitudinal direction is essentially along a vertical direction. Essentially along a vertical direction means in this context, extending in the direction from a bottom end 24 of the backpack 25 to a top end 23 of the backpack 25 but allowing for a sideways deviation of up to 30°, preferably 20°.

The inventors have found that the dynamic movement of the athlete causes a chimney effect in the first channel 13*a*, thus substantially improving the ventilation provided by the ventilation element 10. For example, the dynamic movement of the athlete, combined with the cushioning and elastic properties of the foam, may cause the spacing between the first surface 11 and the second surface 12 to vary dynamically during use, thereby creating a "breathing" effect.

The first channel 13*a* extends substantially from one end of the article of apparel, footwear, or the sports accessory to another end, i.e. the first channel 13*a* extends substantially from a bottom end 24 to the top end 23. "Substantially" in this context means 80% of the length.

FIG. 3A-D show another example of a ventilation element 10 according to the present invention. The exemplary ventilation element 10 is for the shoulder straps 26 of a backpack, such as the backpack 25 of FIG. 2.

The ventilation element 10 comprises: a first surface 11, comprising a foam; a second surface 12; wherein the first surface 11 and the second surface 12 are spaced apart, creating a void, so that air may circulate between the first surface and the second surface.

In this example, the first surface 11 contacts a body part, such as a shoulder (or clothing, e.g. a shirt, worn by an athlete) directly during normal use of the backpack.

In this example, it is desired that the ventilation element 10 is particularly elastic in order to absorb shocks resulting from the dynamic movement of the athlete. The foam therefore has an elongation at break of 300%. This way, the ventilation element 10 may help to absorb shocks resulting from the dynamic movement of the athlete without tearing or breaking. The foam also has a very low elastic modulus of 10 MPa. This way, the ventilation element 10 is very stretchable thus helping to absorb shocks resulting from the dynamic movement of the athlete.

FIGS. 4A-4C show an exemplary ventilation element 10 for a shoulder strap 26 and a method for producing the same according to the present invention. In particular, the ventilation element 10 provides both a ventilation and a suspension, i.e. a shock-absorbing, function.

FIG. 4A shows a shoulder strap 26 for a backpack. The shoulder strap 26 comprises a ventilation element 10 according to the present invention as well as a fabric 48 comprising a woven material.

The ventilation element 10 comprises a first surface 11 (shown in the cross-sectional view in the bottom right), comprising a foam and a second surface 12; wherein the first surface 11 and the second surface 12 are spaced apart, creating a void 21, so that air may circulate between the first surface and the second surface.

In this example, the first surface 11 contacts a body part (or clothing, e.g. a shirt, worn by an athlete) only indirectly during normal use of the backpack since the fabric 48 extends behind the first surface 11. However, it is also possible that the fabric 48 extends only around the edges and not behind the first surface 11.

In this example, the second surface may not contact a contacting portion of the backpack during normal use. A contacting portion may be any portion of the article of apparel, footwear, or the sports accessory. In this example, the ventilation element 10 is not arranged between a contacting portion and a body part during normal use. Therefore, the first surface may only indirectly contact the body part (or clothing, e.g. a shirt, worn by an athlete). However, it is possible that the ventilation element is arranged between the contacting portion and the body part during normal use.

The ventilation element 10 comprises a first bridge 18*a* and a second bridge 18*b*, formed in a thermoforming process wherein the first surface 11 is an inward-facing surface of the first bridge 18*a* and the second surface 12 is an outward-facing surface of the second bridge 18*b*. The first bridge 18*a* comprises a low portion 19 and the second bridge 18*b* comprises a raised portion 20. The second surface 12 is an outward-facing surface of the raised portion 20 of the second bridge 18*b*. The first surface 11 is an inward-facing surface of the low portion 19 of the second bridge 18*b*. The first bridge 18*a* and the second bridge 18*b* also each comprise a ramping portion 49. The ramping portion 49 connects the low portion 19 of the first bridge 18*a* to the surrounding area 43. The ramping portion 49 connects the raised portion 20 of the second bridge 18*b* to the surrounding area 43.

Inward-facing means, in this case, towards the body part and towards the fabric 48 of the shoulder strap 26. Outward-facing means, in this case, away from the body part and the fabric 48 of the shoulder strap 26.

The ventilation element 10 comprises a plurality of first bridges and a plurality of second bridges arranged to extend outwards and inwards in an alternating manner.

The ventilation element 10 comprises an elastic portion 44 and a less-elastic portion 47. The difference in the elasticity between the elastic portion 44 and the less-elastic portion 47 is effected by a different elastic modulus of the elastic portion 44 and the less-elastic portion 47. In this example, the elastic modulus of the elastic portion 44 is 2 MPa, while the elastic modulus of the less-elastic portion 47 is 10 MPa. This difference in elastic modulus may be effected by a different material composition of the elastic portion 44 and the less elastic portion 47.

A cross-section is shown in the bottom right of FIG. 4A showing the first surface 11 and the second surface 12. In this example, a spacing 46 along an outward-facing direction between the first surface 11 and the second surface 12 is 2 cm. A thickness 45 of the first bridge and the second bridge is 5 mm.

FIG. 4B shows the semi-finished ventilation element 41 used for producing the ventilation element 10 shown in FIG. 4A. The semi-finished ventilation element 41 comprises ethyl vinyl acetate (EVA) foam.

This semi-finished ventilation element 41 is shaped to generally conform to the shape of the shoulder strap 26. The semi-finished ventilation element 41 comprises a plurality of cuts 42. The plurality of cuts 42 is produced by a die-cutting process.

The second surface 12 is indicated in the figure. However, it is to be understood that at this stage, the semi-finished ventilation element 41 is essentially flat.

FIG. 4C shows the finished ventilation element 10 prior to incorporation into the shoulder strap 26. A spacing 46 between the first surface 11 and the second surface 12 is formed by the application of heat and/or pressure. Such a method may be described as thermoforming. In this example, the semi-finished ventilation element 41 is pressed and heated in a form in order to form the spacing 46 between the first surface and the second surface.

The ventilation element 10 comprises a first bridge 18*a* and a second bridge 18*b*, formed in a thermoforming process wherein the first surface is an inward-facing surface of the first bridge 18*a* and the second surface 12 is an outward-facing surface of the second bridge 18*b*. The first bridge 18*a* comprises a low portion 19 and the second bridge 18*b* comprises a raised portion 20. The second surface 12 is an outward-facing surface of the raised portion 20 of the second bridge 18*b*. The first surface is an inward-facing surface of the low portion 19 of the second bridge 18*b*. The first bridge 18*a* and the second bridge 18*b* also each comprise a ramping portion 49. The ramping portion 49 connects the low portion 19 of the first bridge 18*a* to the surrounding area 43. The ramping portion 49 connects the raised portion 20 of the second bridge 18*b* to the surrounding area 43.

The ventilation element 10 maintains its different elastic properties during the thermoforming process such that the ventilation element 10 comprises an elastic portion 44 and a less-elastic portion 47. Therefore, the shoulder strap 26 comprising the ventilation element 10 may provide both a ventilation and a suspension, i.e. a shock-absorbing, function.

FIG. 5 shows a shoulder strap 26 for a backpack 25. The shoulder strap 26 comprises a ventilation element 10 according to the present invention as well as a mesh 51.

The ventilation element 10 comprises: a first surface 11, comprising a foam; a second surface 12; wherein the first surface 11 and the second surface 12 are spaced apart, creating a void 21, so that air may circulate between the first surface and the second surface. The first surface 11 and the second surface 12 are arranged to form a plurality of channels 13 in the void 21.

The purpose of the mesh is to evenly distribute the load on a body part 50, in this example especially the shoulder, of the wearer. In this example, the first surface 11 contacts the body part 50 indirectly, since the mesh 51 is arranged between the first surface 11 and the body part 50. However, it is also possible that the first surface 11 contacts the body part (or clothing such as a shirt) directly. For example, in other embodiments, there may be no mesh 51 such that the first surface 11 is in direct contact with the body part (or clothing such as a shirt). It is possible that the shoulder strap 26 consists only of the ventilation element 10 and no additional components.

REFERENCE SIGNS

10: ventilation element
11: first surface
12: second surface
13*a-d*: first-fourth channel
14: recess
15: first end
16: second end
17: location between first end and second end
18*a*: first bridge
18*b*: second bridge
19: low portion
20: raised portion
21, 21*a-c*: void
22: axis through interface
23: top end
24: bottom end
25: backpack
26: shoulder strap
27: main compartment
41: semi-finished ventilation element
42: cut
43: surrounding area
44: elastic portion
45: thickness
46: spacing
47: less-elastic portion
48: fabric
49: ramping portion
50: body part
51: mesh

What is claimed is:

1. A ventilation element for an article of apparel, footwear, or a sports accessory, comprising:

a first bridge extending in a first direction, wherein the first bridge comprises a first surface configured to contact a body part of a user of the article of apparel, the footwear, or the sports accessory, and wherein the first bridge comprises a foam;

a second bridge extending in a second direction and spaced apart from the first bridge in a third direction that is perpendicular to the first direction and the second direction such that a void is formed between the first bridge and the second bridge; and a recess adjacent to the first bridge and the second bridge, the recess extending in the third direction and having a width in a fourth direction perpendicular to the first direction, the second direction, and the third direction, wherein the second bridge comprises a second surface configured to contact a portion of the article of apparel, the footwear, or the sports accessory, wherein the second direction is opposite of the first direction, and wherein a bottom of the recess is coplanar in the third direction and the fourth direction with a low portion of the first bridge and a raised portion of the second bridge.

2. The ventilation element according to claim 1, wherein the first surface has a first surface area and the second surface has a second surface area and the ratio of the first surface area and the second surface area is between 0.2 and 5.

3. The ventilation element according to claim 2, wherein the first bridge and the second bridge are arranged to form a first channel in the void.

4. The ventilation element according to claim 1, wherein the first bridge and the second bridge are arranged adjacent to each other.

5. The ventilation element according to claim 1, wherein a spacing between the first bridge and the second bridge is at least 0.5 cm and no more than 5 cm.

6. The ventilation element according to claim 1, wherein a thickness of the first bridge and/or the second bridge is between 0.5 mm and 20 mm.

7. The ventilation element according to claim 1, wherein the second bridge comprises the foam.

8. The ventilation element according to claim 1, wherein the foam comprises a thermoplastic polymer.

9. The ventilation element according to claim 1, wherein the foam has a hardness of 10-80 Shore A.

10. The ventilation element according to claim 1, wherein the foam has a density of between 25 and 400 kg per cubic meter.

11. The ventilation element according to claim 1, wherein the foam has an elongation at break of at least 50%.

12. The ventilation element according to claim 1, wherein the foam has an elastic modulus of 1 to 100 MPa.

13. The ventilation element according to claim 1, wherein the foam comprises ethyl vinyl acetate.

14. The ventilation element according to claim 1, wherein the ventilation element is a single unitary piece.

15. An article of apparel, footwear, or a sports accessory comprising the ventilation element according to claim 1.

16. The ventilation element according to claim 1, wherein the recess extends continuously in the third direction.

17. A ventilation element for a sports accessory, comprising:

a first plurality of bridges extending in a first direction, wherein each of the bridges of the first plurality of bridges comprises a surface configured to contact a body part of a user of the sports accessory;

a second plurality of bridges extending in a second direction and spaced apart from the first plurality of bridges; and a first channel defined by the first plurality of bridges and the second plurality of bridges such that air flows through the first channel to ventilate the sports accessory, wherein each of the bridges of the second plurality of bridges comprises a surface configured to contact a portion of the sports accessory, wherein the second direction is opposite of the first direction, wherein the bridges of the first plurality of bridges and the bridges of the second plurality of bridges are arranged on the ventilation element in an alternating pattern, and wherein a low portion of one of the plurality of first bridges and a raised portion of one of the plurality of second bridges are level with each other and extend in a third direction and a fourth direction, wherein the third direction is perpendicular to the first direction and the second direction, and wherein the fourth direction is perpendicular to the first direction, the second direction, and the fourth direction.

18. The ventilation element of claim 17, further comprising:

a third plurality of bridges extending in the first direction;

a fourth plurality of bridges extending in the second direction and spaced apart from the third plurality of bridges such that a second channel is formed between the third plurality of bridges and the fourth plurality of bridges;

a first recess arranged between the first plurality of bridges and the third plurality of bridges; and a second recess arranged between the second plurality of bridges and the fourth plurality of bridges.

19. The ventilation element according to claim 18, wherein the first plurality of bridges is aligned with the third plurality of bridges in the fourth direction, and wherein the second plurality of bridges is aligned with the fourth plurality of bridges in the fourth direction.

20. The ventilation element of claim 17, wherein the first channel comprises:

a first width at a first end of the first channel;

a second width at a second end of the first channel; and a third width at a location between the first end of the first channel and the second end of the first channel, wherein the first width and the second width are each greater than the third width.

* * * * *